United States Patent [19]

Mayotte et al.

[11] Patent Number: 5,007,823

[45] Date of Patent: Apr. 16, 1991

[54] DUST RECYCLING TO ROTARY KILNS

[75] Inventors: Leo G. Mayotte, Whitehall; Prince B. Eleazer, Allentown, both of Pa.

[73] Assignee: Air Products and Chemicals, Inc., Allentown, Pa.

[21] Appl. No.: 444,493

[22] Filed: Dec. 1, 1989

[51] Int. Cl.[5] ..... F27B 15/00; F27B 7/32

[52] U.S. Cl. ..... 432/14; 432/105; 432/117

[58] Field of Search ..... 432/111, 105, 117, 14

[56] References Cited

U.S. PATENT DOCUMENTS

| | | | |
|---|---|---|---|
| 3,074,707 | 1/1963 | Humphries et al. | 263/53 |
| 3,193,266 | 7/1965 | Becker | 432/117 |
| 3,206,526 | 9/1965 | Rygaard | 432/117 |
| 3,397,256 | 8/1968 | Paul et al. | 263/52 |
| 4,461,645 | 7/1984 | Roth et al. | 432/117 |
| 4,517,020 | 5/1985 | Steinbiss et al. | 432/105 |
| 4,741,694 | 5/1988 | Mason et al. | 432/14 |

*Primary Examiner*—Henry C. Yuen

*Attorney, Agent, or Firm*—James C. Simmons; William F. Marsh

[57] ABSTRACT

A process and apparatus are described for recycling dust generated in rotary kiln processes such as cement manufacture. The invention resides in enriching the atmosphere in the kiln with oxygen so as to increase the heat generated and accommodate the introduction of recycled kiln dust. The oxygen enrichment and dust recycle are balanced so that the kiln operates to produce the same quality product as it did without either oxygen enrichment or dust recycle.

4 Claims, 1 Drawing Sheet

DUST RECYCLING TO ROTARY KILNS

TECHNICAL FIELD

This invention relates to an improvement in waste dust recycling for rotary kilns. More particularly it relates to the use of both oxygen addition and dust recycling to control the flame geometry in a rotary kiln. Rotary kilns are used for thermal processing many mineral products including, but not limited to calcining clays, vanadium oxide, phosphate rock, alumina, lime, and cements.

BACKGROUND OF THE INVENTION

Due to the tumbling action and gas flow patterns, rotary kilns generate dust. This dust consists of the fines in the feed materials and fines generated by the breakdown of larger feed particles due to attrition. To date, no one has been able to eliminate dust generation in rotary kilns.

This invention is a process by which two opposing effects are used to maintain a desired flame geometry in a rotary kiln. Dust insufflation will cool and lengthen the flame in a rotary kiln. Oxygen addition will shorten and intensify it. By suitably proportioning dust and oxygen addition while properly fueling the furnace, the flame geometry required for a particular rotary kiln is maintained while dust utilization is increased.

During the thermal processing of mineral products a certain amount of dust is entrained in the gas system exhausting the kiln. This dust is primarily composed of partially processed product. Some of the dust may be completely processed product, unburned carbon, condensates and eroded furnace lining. The dust is usually collected in an environmental control system (baghouse, cyclone separator, electrostatic precipitator, etc.) to keep the furnace particulate emissions within the air quality guidelines.

This dust is not marketable as the originally intended finished product. It presents a disposal problem and is sometimes hazardous. The amount of dust generated can vary widely but is typically 4 to 15% of the theoretical yield of product.

If this dust can be recycled into the product, a disposal cost is eliminated and production can be increased with no cost increases upstream of the kiln (i.e. mining, grinding, etc.)

Heretofore little or no waste dust could be recycled into the kiln. Mixing with kiln feed does not work because the fine dust particles become entrained in the counter flow (flue) gas stream. Introduction into the furnace hot end produces a lengthening of the flame and a cooling in the flame temperature causing lower heat flux and incomplete heat treatment of the product.

Some dust has been successfully recycled in wet process cement kilns. This technique. known as insufflation, is very limited, however, in the amount of dust which can be recycled. Insufflation has been done through the fuel burner pipe and also through dust injection pipes located near the burner pipe. The most common position of the dust injection pipe is above and parallel to the burner pipe. slightly offset from directly above the burner pipe.

Previous recycle attempts have had limited success for a number of reasons. The primary reason is that the dust decreases the rate of the combustion reaction and thereby lowers the flame temperature. Other undesirable operational effects include high CO emissions, increase in the cold end kiln temperature, too long a flame, product increases greater amounts of incomplete clinker formation, low free lime, and increased cold end dust generation.

Historically, high dust losses were not a high priority concern until government land reclamation laws such as the Resource Conservation and Recovery Act (RCRA) affected disposal. Costs associated with mining and feed preparation are not a significant part of production cost, as are product firing cost.

BRIEF SUMMARY OF THE INVENTION

In the present invention oxygen injection is used to obtain a desired flame geometry and is dependent on the dust injection system and kiln geometry in order to allow oxygen to counteract the effect of dust recycling on flame geometry. For example, a cement rotary kiln that returns dust through the burner pipe or above the burner would cause the fuel ignition point to be delayed and a cooling of the flame at the dust/fuel interface point. To counteract these effects, an oxygen enrichment is provided in the present invention.

This invention allows a rotary kiln operation to increase dust return to the process, thus increasing yields and minimizing dust disposal cost. This is accomplished by using oxygen enrichment to control flame geometry and combust the extra fuel required to convert the added dust into final product.

This invention provides kiln operators with a means to increase dust return or to dust insufflate when heretofore kiln temperature (i.e. lime kilns) would not allow it. The fact that oxygen enrichment increases the rate of combustion reaction and flame temperature is well known. In the process of this invention such oxygen enrichment is used to counteract an opposite effect in order to maintain the proper flame geometry. Therefore, product quality, equipment operation, and temperature profile are maintained constant while increasing product yield and diminishing dust disposal cost.

In cement processes where dust insufflation is practiced, the upper limit of the rate of dust return is determined by the requirement to maintain the desired kiln temperature profile. Maximized dust disposal is by returning as much dust as the process will allow.

DETAILED DESCRIPTION OF THE INVENTION

Figures 1, 2:
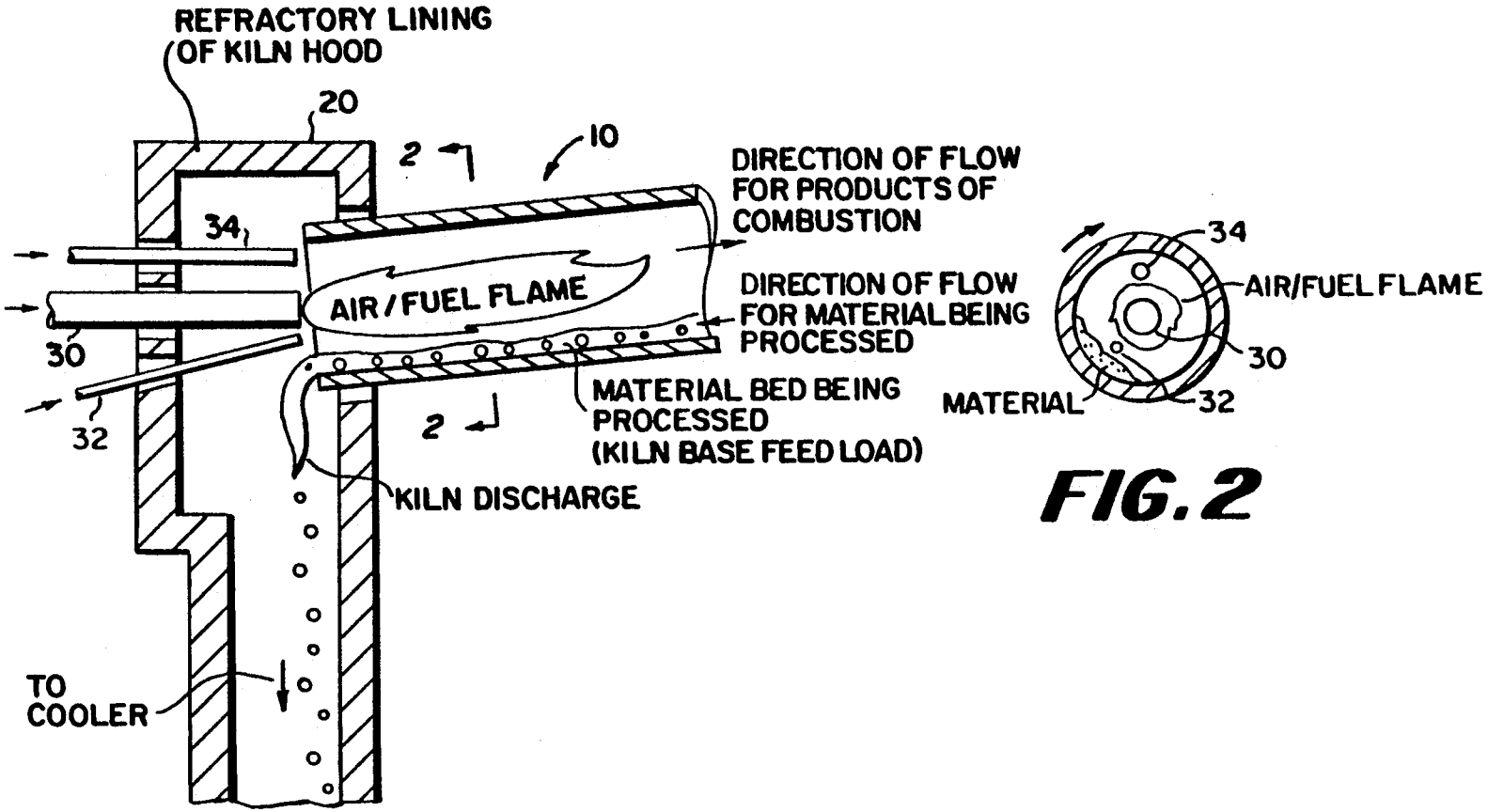
FIG. 1 is a schematic fragmentary view of the discharge end of a rotary kiln embodying the invention.
FIG. 2 is a section taken along line 2—2 of FIG. 1.

The combustion of a fuel with oxygen results in a flame. The heat released from this flame is a function of the flame geometry, e.g. a very hot short flame will provide a very localized heat transfer area. Of importance to a rotary kiln operation is a slow increase in temperature over a large surface area covering the calcining zone. The shape of a flame in a rotary kiln is a function of:

a. kiln geometry
b. burner design
c. fuel
d. Combustion air (primary or secondary) temperature and pressure
e. oxygen concentration
f. front end temperature g. draft and other variables Addition of dust or dust insufflation in a flame will cause this flame to lengthen as the dust particulates act as a diluent in the flame atmosphere. The result is a reduction of the reaction rate, thus increasing the reaction time to fully combust the fuel. As this occurs, a shift in the temperature profile of a rotary kiln will occur, resulting in a cooling of the burner end as less fuel is combusted in that area.

Increasing the oxygen concentration will increase the combustion rate of a fuel. Adding oxygen to raise the concentration above 21% will result in a shortening and intensification of the flame.

The addition of oxygen to a rotary kiln for the manufacture of cement by either a wet process or a dry process is described in Humphries, et al., U.S. Pat. No. 3,074,707 issued Jan. 22. 1963, the disclosure of which is incorporated herein by this reference for the purpose of describing conventional kiln structure with oxygen enrichment (see FIG. 1 of Humphries).

In the past oxygen has been added as described in Humphries or by use of separate oxygen fuel burner as described in Paul, et al., U.S. Pat. No. 3,397,256 issued Aug, 13, 1968, or by undershot lancing as described in Mason No. 4,741,694 issued May 3, 1988, or by other known arrangements.

In the present invention the oxygen is introduced into the rotary kiln by a pipe or lance located in the kiln in the manner described by Humphries, et al. At the same time dust collected with the gases discharged from the kiln is recycled into the kiln by being blown in through a pipe located above the burner used to heat the kiln.

As shown in the drawings rotary kiln 10 has a discharge end through which material fed at the entry end of the kiln is discharged after being processed in the kiln. A housing 20 is provided around the discharge end of the kiln. A burner 30 is mounted to extend through the housing and into the kiln. Located below the burner is an oxygen injection lance 32 and located above the burner slightly offset (e.g. at either 11 o'clock or 1 o'clock) is a dust insufflation pipe 34. The oxygen lance may be retracted or advanced so as to provide oxygen concentration in the kiln above 21% by volume and a desired temperature pattern at the discharge end, according to the amount of dust being insufflated. The location of the oxygen pipe is as described in Humphries, et al., U.S. Pat. No. 3,074,707.

One trial of oxygen-assisted dust insufflation operation was done on a 2400 TPD wet process kiln firing a coal: coke fuel blend. A 0.9% enrichment of total air was used to obtain the following results:

| | |
|---|---|
| Dust generation | constant |
| Dust return | 33% higher |
| Feed | 3% higher |
| Dust wasted | 15% decrease |
| Yield (prod./feed as clinker equivalent increase) | 5 percentage point improvement |
| Specific Fuel Consumption (fuel per unit of production) | 6% decrease |

The above data shows a combination of production and yield increase through feed and dust insufflation increase respectively. This was the result of dust return equipment limitation at the time of testing. Later testing showed that keeping the feed rate constant improved the result in the following fashion when compared to the base data:

| | |
|---|---|
| Dust generation | Constant |
| Dust return | 65-75% increase |
| Yield | 6-7% increase |
| Dust wasted | 10-15% of dust generated |
| Specific Fuel Consumption | 6% decrease |

The small portion of dust wasted is the high alkali fraction and is considered non-reusable. This represents approximately 2-3% of production rate. In this case, the undershot enrichment allows the kiln operator to maximize yield by allowing him to return all the available dust. Also, the 0.9% volume-percent enrichment level of the total air flow maintained the total volatile concentration of the burning zone constant. This is equivalent to 9000 SCFH/Ton of dust. The product quality was unchanged. Back end temperature was maintained at 425°-450° F., and refractory wear was not noticeably changed over a period of six months of continuous operation. Other benefits of the oxygen enrichment practice were increased stability and recovery from low temperature excursion. This can be explained by reducing dust actually increase the volatility content of the burning zone. This, in fact, improves the combustion process by lowering the ignition temperature or by increasing combustible availability.

From the trial data where dust insufflation was maximized the secondary air temperature and back end temperature were relatively constant. Also, the kiln $NO_x$ was maintained constant. This results in an actual decrease in $NO_x$ per actual ton produced.

Another trial was conducted at another cement plant in which oxygen was added through lance 32 in amounts so as to keep the burning zone constant (flame position and geometry and product temperature profile) while increasing the quantity of coke burned from 0 to 25% and reducing coal from 100 to 75%, the oxygen was added to maintain rate of combustion constant. In this case, $NO_x$ data and quality data were taken and showed that controlling volatile allowed one to control the flame geometry, position and temperature and thus produced an identical quality product and $NO_x$ emission.

The present invention has been specifically designed to be an independent operation loop operating within the existing kiln parameters. In the present invention:

a. A pure oxygen lance system is used to introduce oxygen rather than an oxygen-fuel burner. This is a significant difference as pure oxygen alone does not produce the intensely hot and highly directional flame resulting from an oxygen-fuel burner.

b. The kiln burning zone length is maintained constant.

c. Product residence time and temperature profile are maintained the same as that previously used to meet quality requirements.

d. Draft was not reduced as it would shorten the burning zone, shift the coating build-up on the kiln wall, lower the feed end temperature and finally shift the drying, preheating, calcining and clinkerization zone toward the exit end of the kiln.

The dust insufflation technology of this invention is based on maintaining status quo in the burning zone. The dust insufflation injection point will dictate the counter measure required. For example, if dust is added to the fuel, this will lengthen the flame due to a reduction in volatile content. A 1% enrichment of the primary air will give the same effect as increasing volatile content by 4%. Maintaining the effective volatile content means that flame geometry, length and temperature will be the same. Therefore, the oxygen addition can be calculated to compensate for the dilution of the flame. On the other hand, if dust is added in the space between the flame and the product and this area is defined as the flame, maintaining a constant volatile content of this space, will keep the boundaries constant, in the cases with and without oxygen. Therefore, the flame is not intensified but rather stabilizes by keeping volatile content above the minimum requirement. This minimum is different for every kiln as it depends on factors such as burner and kiln design, air and fuel flow, pressure and temperature. Such factors define the stability of the combustion process and flame geometry.

Because there is no change in the temperature of the flame nor the length of the burning zone, other significant benefits can be achieved. It is feasible to insufflate particles, either fine raw materials or kiln dust, into lime kilns. This can not be done with an intense oxygen-fuel flame as it would overburn the Calcium Oxide in the feedbed, making it non-reactive. This invention provides an effective way of controlling nitrous oxide ($NO_x$) emissions from a kiln. This is done by injecting heat absorbing particles into the flame and thereby reducing the flame core temperature.

For the purposes of the present invention between 2% and 20% by weight of the feed material can be recycled dust and the amount of oxygen enrichment should result in an oxygen concentration before combustion of betwen 21% and 25% by volume of the air/fuel mixture.

Having described a preferred embodiment of the invention it is not intended that it be limited except as it may be defined in the appended claims.

We claim:

1. In a process for the operation of a rotary kiln for the thermal processing of a mineral feed by combustion of a fuel with air producing a flame in said kiln and in which a dust is generated from the mineral feed and is recovered from the combustion products exiting said kiln and recycled to said kiln, the improvement which comprises: enriching the air fed into said kiln to combust fuel introduced into said kiln with oxygen concurrently with the recycling of said dust, raising the amount of oxygen sufficiently to raise the concentration of oxygen to above 21% in said kiln and to thereby tend to shorten and intensify said flame and balancing the amount of dust being recycled to said kiln with consequent cooling of and lengthening of said flame against the amount of oxygen enrichment, thereby maintaining the temperature profile of said kiln at the same level as when the kiln was operated without oxygen enrichment and without dust recycling, and wherein the material being processed is a mineral selected from the group consisting of aluminas, clays, limes, cements and other oxides, and the amount of dust recycled comprises between 2% and 20% by weight of the feed material.

2. The process of claim 1 wherein the material being processed produces cement as the product.

3. The process of claim 1 wherein the amount of oxygen enrichment results in an oxygen concentration before combustion of between 21% and 25% by volume.

4. The process of claim 1 wherein the oxygen enrichment is effected by means of an oxygen lance.

* * * * *